US009618193B1

(12) United States Patent
Lord

(10) Patent No.: US 9,618,193 B1
(45) Date of Patent: Apr. 11, 2017

(54) GARMENT DOCKING DEVICE FOR ATTACHING PERSONAL DEVICES

(71) Applicant: Jeremy William Lord, West Linn, OR (US)

(72) Inventor: Jeremy William Lord, West Linn, OR (US)

( * ) Notice: Subject to any disclaimer, the term of this patent is extended or adjusted under 35 U.S.C. 154(b) by 0 days.

(21) Appl. No.: 15/153,273

(22) Filed: May 12, 2016

(51) Int. Cl.

| | |
|---|---|
| ***F21V 21/088*** | (2006.01) |
| ***F21V 21/08*** | (2006.01) |
| ***A45F 5/02*** | (2006.01) |
| ***F21V 23/04*** | (2006.01) |
| ***H05B 33/08*** | (2006.01) |
| ***H05B 37/02*** | (2006.01) |
| ***F21V 31/00*** | (2006.01) |
| *F21Y 101/02* | (2006.01) |

(52) U.S. Cl.
CPC ..... *F21V 21/08* (2013.01); *A45F 5/02* (2013.01); *F21V 23/04* (2013.01); *F21V 23/0471* (2013.01); *F21V 31/005* (2013.01); *H05B 33/0845* (2013.01); *H05B 33/0857* (2013.01); *H05B 37/029* (2013.01); *F21Y 2101/02* (2013.01)

(58) Field of Classification Search
CPC ..... A41D 19/0157; A14D 27/085; F21V 33/0008
USPC ..... 362/103, 105, 190
See application file for complete search history.

(56) References Cited

U.S. PATENT DOCUMENTS

| | | | | |
|---|---|---|---|---|
| 5,746,500 | A * | 5/1998 | Chien | A43B 1/0036 36/137 |
| 2008/0037242 | A1* | 2/2008 | Long | A45C 15/06 362/156 |
| 2012/0042480 | A1* | 2/2012 | Ingels | A44B 1/18 24/103 |
| 2015/0170480 | A1* | 6/2015 | Chen | G08B 5/004 362/311.01 |
| 2016/0374438 | A1* | 12/2016 | Fujita | A44B 17/0052 24/303 |

* cited by examiner

*Primary Examiner* — Andrew Coughlin
*Assistant Examiner* — Keith Delahoussaye
(74) *Attorney, Agent, or Firm* — Mark S Hubert

(57) ABSTRACT

A docking system for the interchangeable attachment of personal devices such as lights, electronic devices, popular survival and safety equipment and the like, to the outer face of an article of clothing. It has a pair of discs held in a parallel, spaced arrangement by a pair of opposing stanchions so that a slot is created between the disks and the stanchions. Into this slot may be inserted an engageable tab connected normally to an arm that is affixed to, or extends from a personal device, such as an emergency light. The emergency light has a plethora of lighting modes that regulate which of the numerous disposed LEDs will be illuminated and in what pattern.

13 Claims, 19 Drawing Sheets

FIG 18
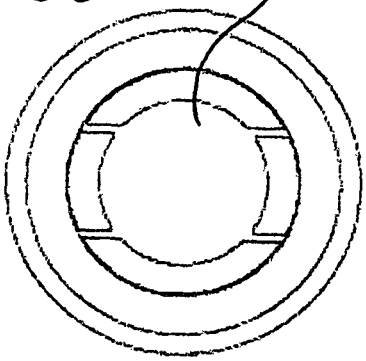
FIG 19
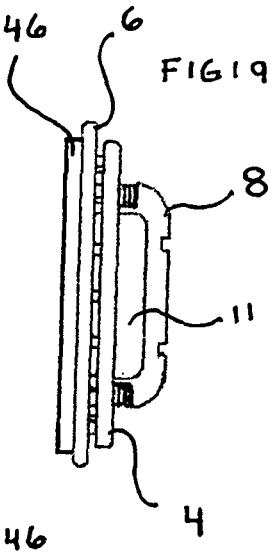
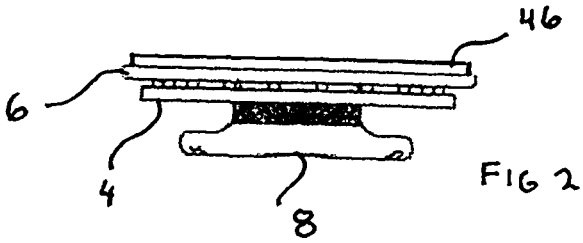
FIG 20
FIG 21
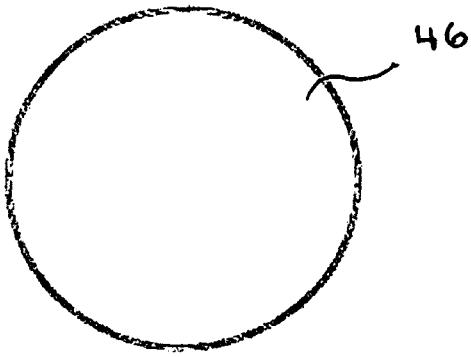

GARMENT DOCKING DEVICE FOR ATTACHING PERSONAL DEVICES

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a device for the interchangeable attachment of personal devices such as lights, electronic devices, popular survival and safety equipment and the like to the outer face of an article of clothing.

BACKGROUND

Skiers, joggers, athletes, hikers, emergency personnel and the like frequently carry a plethora of personal devices with them. Generally, these are contained in their clothing pockets or backpacks. Getting to these personal items is time consuming and inconvenient, especially when colder weather or the job requires hand protection. Often, the personal device's function is best served when in the user's line of sight so that visual and auditory readings, alarms, notices etc., can be rapidly perceived and attended to. Simple items such as flashlights or emergency flashers, require one hand to operate when often two hands are required for another task. Cell phones, even if in speaker mode, cannot always be set down in situ if the user needs both hands for something else. Simply stated, freeing up one's arms from operating or holding a personal device is often very advantageous.

Having quick access to specific personal devices such as cell phones, GPS trackers or microphones greatly simplifies many situations. Especially if they can be securely held in the user's line of sight. The prior art focuses on clips, belts, harnesses or lanyards that attach to the user's pants, waist or torso. These are bulky, heavy, uncomfortable and often covered up when heaver outer clothing is worn. Henceforth, an improved method of holding such personal devices on the outside of the user's garments would fulfill a long felt need in the outdoor and sport clothing industry. This new invention utilizes and combines known and new technologies in a unique and novel configuration to overcome the aforementioned problems and accomplish this.

BRIEF SUMMARY

In accordance with various embodiments, a garment dock system with an optional, matingly engageable emergency light is provided.

In one aspect, embodiments of a garment dock system are provided that may be incorporated into numerous articles of clothing such as jackets, hats, socks or to wearable straps. The garment dock accommodates a simple style of clip that securely and simply engages with the dock.

In another aspect, an inexpensive, lightweight garment dock that can simply and cheaply be coupled to articles of clothing in a manner designed to spread out the mass of the personal items to be suspended from the dock so as to maintain the visual aesthetics and structural integrity of the article of clothing, is provided.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

FIG. 18 is a front view of a first alternate embodiment garment dock;

FIG. 19 is a side view of the first alternate embodiment garment dock;

FIG. 20 is a top view of the first alternate embodiment garment dock;

FIG. 21 is a front view of the first alternate embodiment adhesive pad;

DETAILED DESCRIPTION OF CERTAIN EMBODIMENTS

Figures 1, 2:
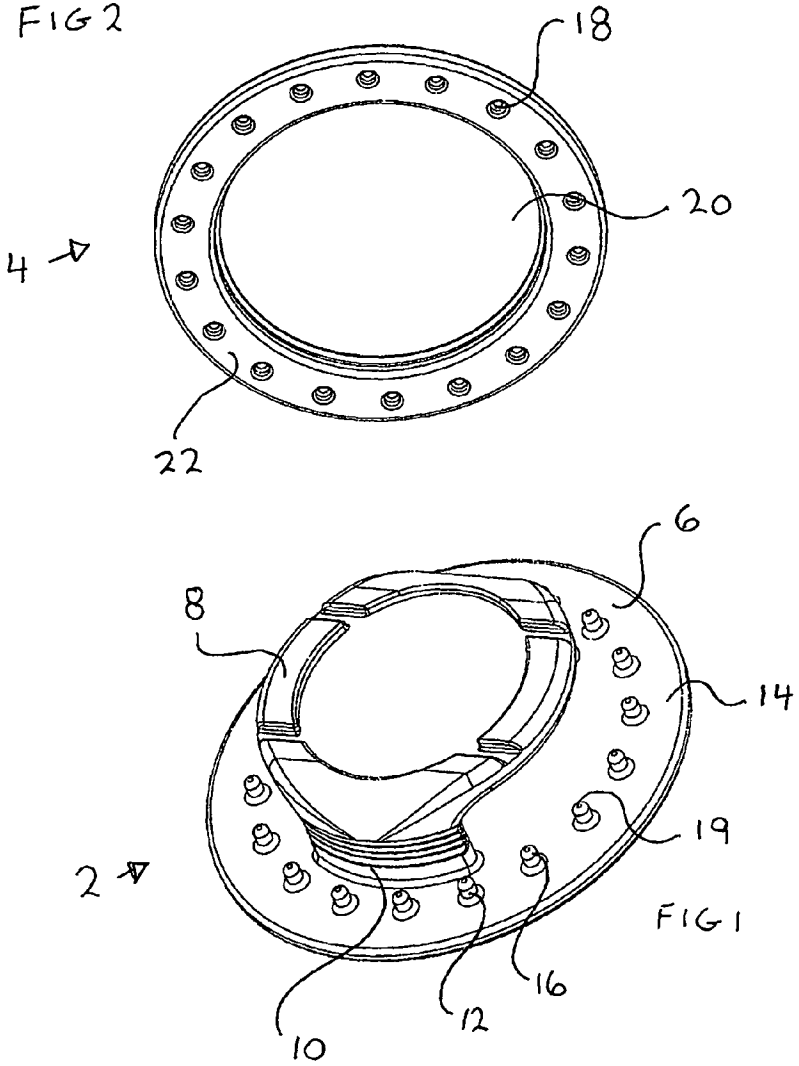
FIG. 1 is a front perspective view of the garment dock post plate.
FIG. 2 is a rear perspective view of the clamp ring.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Two embodiments are described herein, and while various features are ascribed to the different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein the term "personal device" refers to an small article commonly carried by an individual for the purposes of communication, safety, mapping, lighting, tracking; security, emergency or convenience. Such devices include but are not limited to phones, GPS, lights, cameras, knifes, signal beacons, stereos and recorders.

As used herein the term "garment dock system" refers to the garment dock and the matingly engageable retention arm.

As used herein the term "docking device, dock and garment dock" are interchangeable terms designating the same device.

The present invention relates to a novel design for a lightweight bracket ("garment dock" or "dock") that can be easily incorporated into the outer face of an article of clothing, and that will allow for the secure attachment of a personal device such as a light, phone, GPS tracker, pedometer, or the like via a connected retention arm. It is attachable in such a manner so as to maintain both the visual aesthetics and the structural integrity of the garment.

While certain features and aspects have been described with respect to exemplary embodiments, one skilled in the art will recognize that numerous modifications are possible. While certain functionality is ascribed to certain system components, unless the context dictates otherwise, this functionality can be distributed among various other system components in accordance with the several embodiments.

The garment dock and emergency light are made of three separable components; a garment dock, a retention arm and the emergency light coupled to the retention arm, that are intended to be utilized together, although there are a plethora of other personal devices may be interchanged with the emergency light. The garment dock may be affixed to various articles of clothing or gear such as hats, bags, harnesses, straps etc., provided that they are constructed of a fabric. In the preferred embodiment, the garment dock is releaseably attached to the retention arm which is coupled to the light, and is located in a highly visible position on the exterior clothing of the party, allowing the party the freedom to use both hands, while the light is set in the desired mode of illumination.

Figure 3:
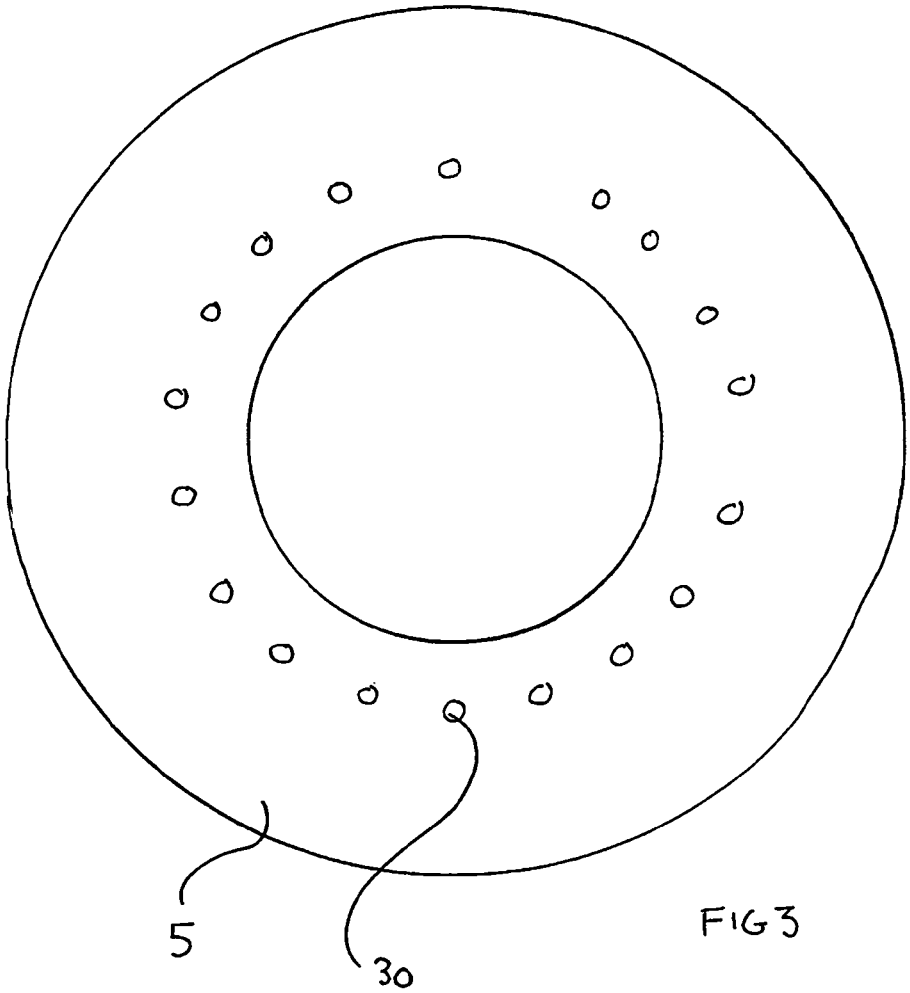
FIG. 3 is a front view of the optional stiffening ring.
Figure 4:
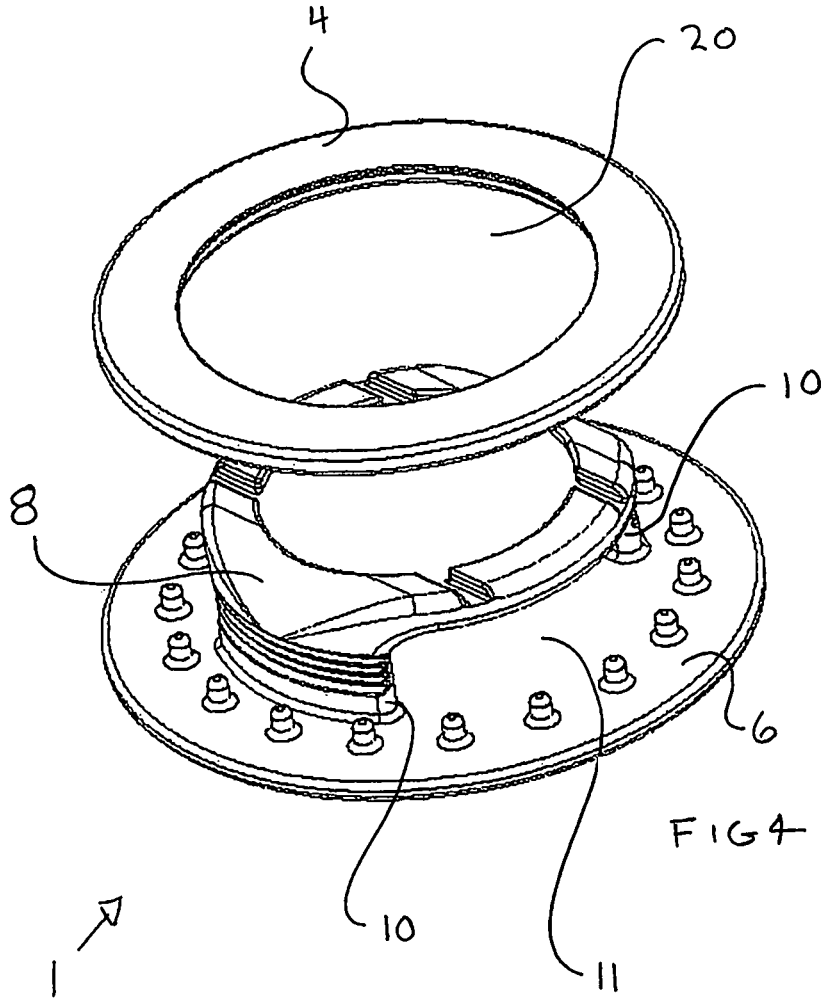
FIG. 4 is a top perspective assembly view of the garment dock without the optional stiffening ring or garment.
Figure 5:
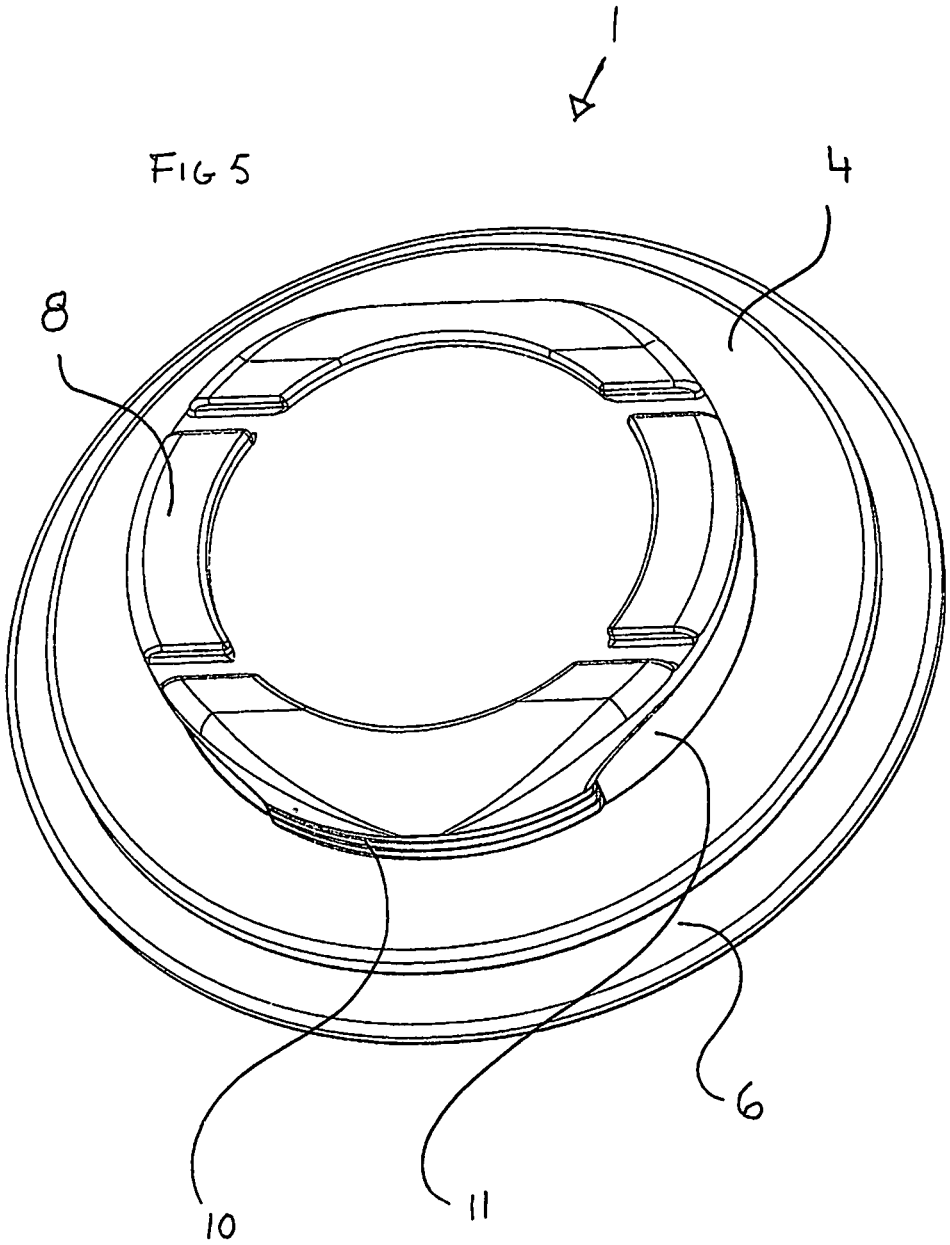
FIG. 5 is a front perspective view of a garment dock post plate affixed to a clamp ring.

The garment dock 1 (FIGS. 4 and 5) is made of a garment dock post plate 2 (FIG. 1) a separate and separable clamp ring 4 (FIG. 2) and an optional stiffening ring 5 (FIG. 3). The preferred material of construction for all these components is a polymer, although a lightweight steel, metal or alloy (such as aluminum) could also be used. The garment dock post plate 2 has a lower, generally planar disk 6 and an upper, generally planar disk 8 held in a generally parallel spaced configuration by a pair of stanchions 10 that extend normally between the two disks. (Although the preferred embodiment utilizes two stanchions, this may be reduced to a single or increased to a multiple number of such stanchions as would be well known by one skilled in the art. In such an embodiment where there is but one stanchion a slot will reside adjacent to the stanchion, bounded between the stanchion and a downward projecting arm from the back face of the upper disk.) In this manner, between the two disks 6 and 8 and the two stanchions 10 there is a through slot 11 formed. This through slot 11 is an encircled volume having a continuous side wall. This through slot 11 is accessible when the garment dock post plate 2 is affixed to a garment, as it is intended for mating engagement with a lock plate attached to a personal device by insertion of the lock plate there through the slot. (See FIGS. 2, 16 and 23) The stanchions 10 are mirror images of each other taken about a plane lying along the centerline of the slot 11, which bisects the upper and lower disks as well. (This same plane also lies along a centerline of the garment dock post plate 2.) Each of the disks 6 and 8 are circular, although other geometric configurations would also work. The lower disk 6 has a larger area (or diameter if the disk is circular) than the upper disk 8. The midpoints of the lower disk 6 and the upper disk 8 are collinear with each other along the central axis of the assembled garment dock 1.

There is a array of spaced nipples 12 extending normally from the upper face 14 of the lower disk 6, located between the outer perimeter of the lower disk 6 and the stanchions 10. Although in the preferred embodiment the nipples 12 are illustrated as a circular array, other shapes of nipple arrays are possible.

The clamp ring 4 has the substantially similar geometric configuration and outer perimeter (or diameter if the ring is circular) as the lower disk 6 with a central cutout 20 sized to allow the upper disk 8 and stanchions 10 to pass through. About the clamp ring's lower face 22 is an array of recesses 18 sized for mating engagement with the array of nipples 12 on the upper face 14 of the lower disk 6 of the dock post plate 2. These recesses 18 are stopped recesses however through bores may also be utilized. Between the lower face 22 of the clamp ring and the upper face 14 of the lower disk 6 the fabric of a garment may be frictionally clamped. The section of fabric therebetween requires a cutout geometrically similar to the periphery of the upper disk 8 and the central cutout 20 in the clamp ring 4. This cutout would have an inside diameter no smaller that that of the upper disk 8 and no larger than the distance between opposing recesses 18 of the array of recesses.

Figure 6:
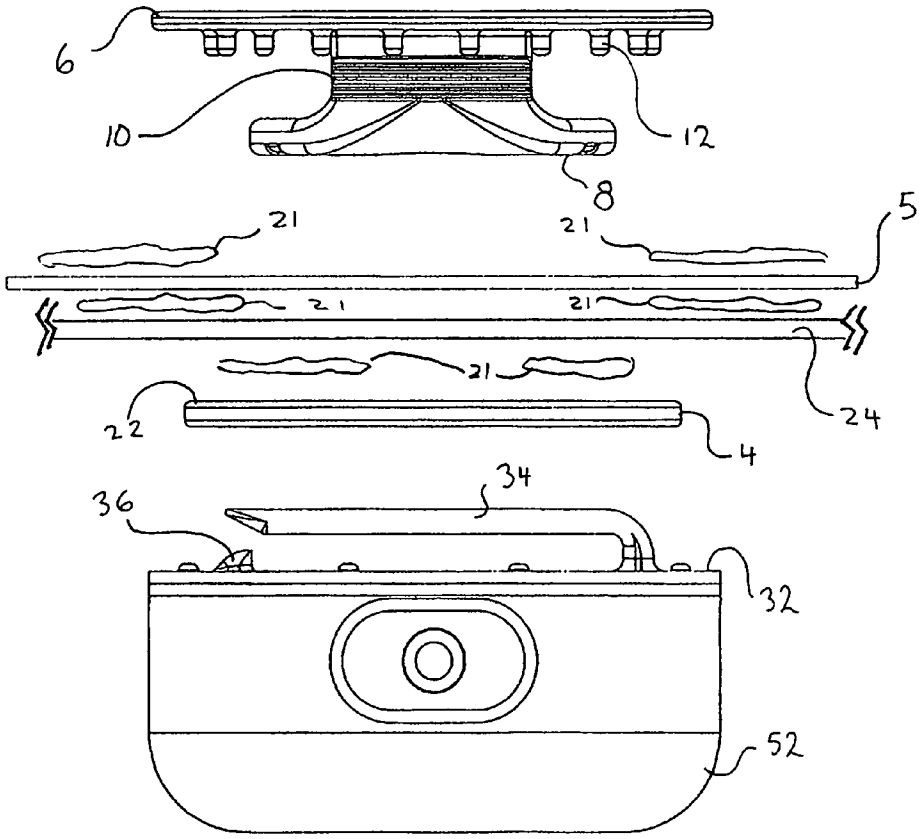
FIG. 6 is a side assembly view of a garment dock with optional stiffening ring and garment fabric.
Figure 7:
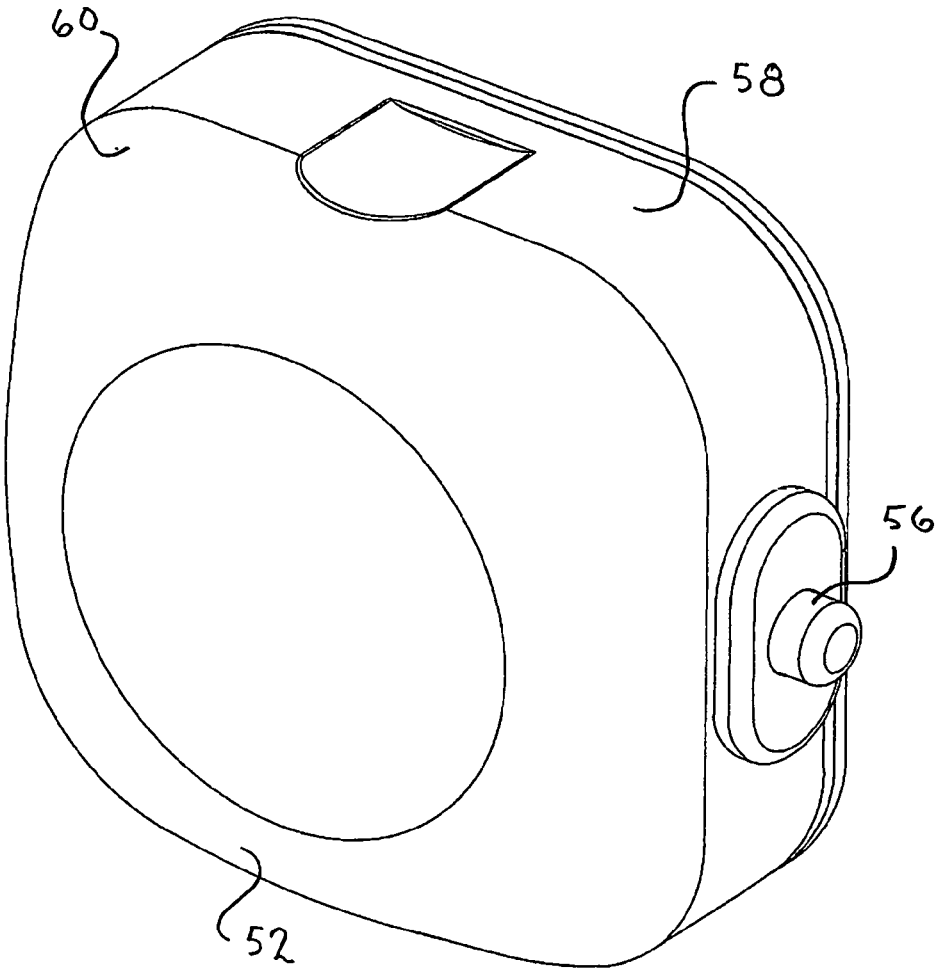
FIG. 7 is a front perspective view of the emergency light.
Figure 8:
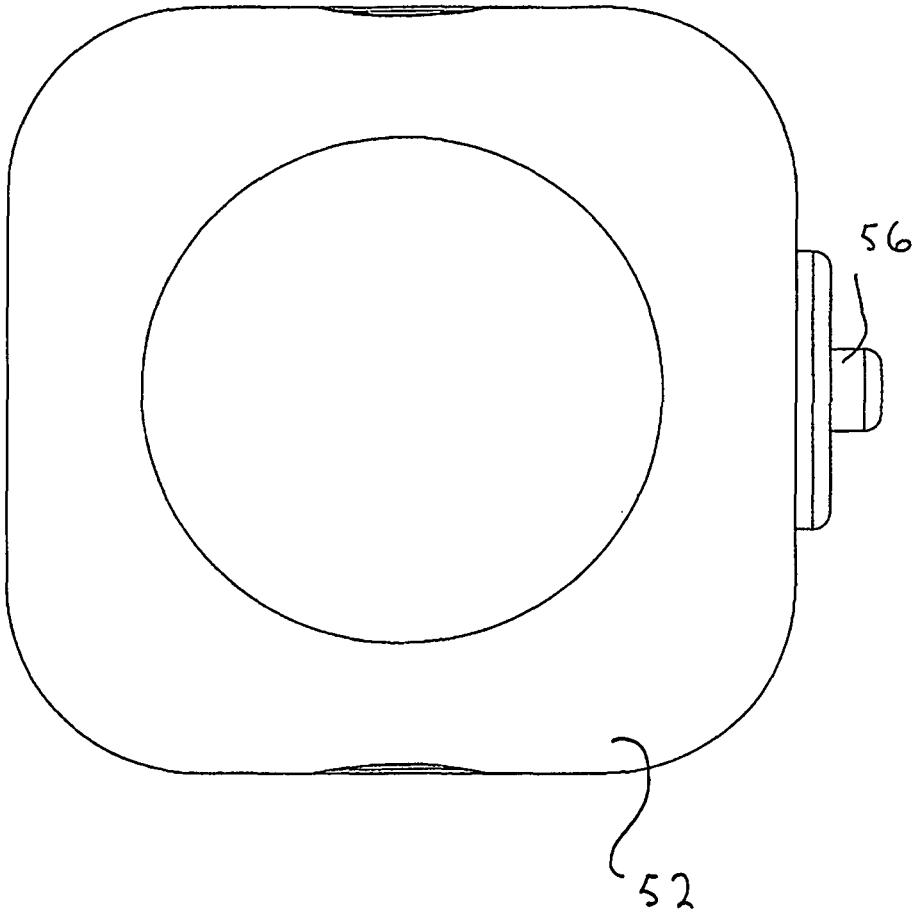
FIG. 8 is a front view of the emergency light.

The nipples 12 in the preferred embodiment are right cylindrical disks with rounded heads 16 and optionally, a shallow longitudinal bore 19 drilled through the center of each head 16. In the preferred embodiment the clamp ring 4 and the dock post plate 2 are joined by an appropriate liquid or hot melt adhesive 21 applied into the recesses 19, and between the upper face 14 of the lower disc 6 and the lower face 22 of the clamp ring 4 (FIG. 6). The adhesive 21 will be of a consistency that will be able to penetrate the garment's fabric 24 allowing for the unified gluing of the clamp ring 4, the garment's fabric 24 and the garment dock post plate 1 (FIG. 6). Where non porous fabrics are used (such as rip stop nylons) the adhesive 21 may be applied to both sides of the fabric 25. In a first alternate embodiment the nipples 12 may have a bulbous head and the recesses of the clamp ring 4 matingly conformed, or in a second alternate embodiment the recesses drilled completely through the clamp ring 4 and the length of the nipples 12 extended. In this first alternate embodiment, the bulbous section would be physically constrained within the clamp ring's recesses and the use of an adhesive 21 would be optional. In the second embodiment the bulbous head would reside on the outside, top face 22 of the clamp ring 4, and again, the use of an adhesive would be optional. The polymer chosen for the construction of the two alternate embodiments would have to be selected so as to impart enough elastic deformation into the clamp ring 4 and the dock post plate 2 to allow the bulbous heads of the nipples 12 to enter into the recesses 18 without damage to either. In other alternate embodiments, different one way fasteners may be utilized as is well known in the industry. Such types of fasteners are commonly found in automotive trim panels.

With the fabric 24 constrained about the outer perimeter of its cutout between the dock post plate 4 and the clamp ring 4, the assembled garment dock 1 will hang suspended from the plane of the garment's fabric with the lower and upper disks 6 and 8 parallel to the plane of the fabric and with the two stanchions 10 extending normally from the plane of the garment fabric.

Where the garment's fabric 24 is thin or flimsy and prone to ease of wrinkle, an optional stiffening ring 5 may be inserted between the fabric 24 and the front face of the of lower disc 6 so as to impart structural rigidity to the garment's fabric 24 in the area where the clothing dock 1 is mounted. The stiffening ring 5 will have a central orifice no smaller than the outer diameter of the upper disk 8 and its outer diameter will extend beyond the outer diameter of the lower disk 6 a distance sufficient to adequately support the clothing dock 1 such that the garment fabric 24 in this area is free from wrinkles and supported from tearing. This stiffening ring 5 may be made of a thin polymer or of a suitably stiff fabric, affixed to the garment fabric 24 by a plethora of methods including stitching, gluing or welding depending upon the materials of use. In FIG. 6 the same adhesive 21 is used to bond all components. The stiffening ring 5 will have an array of openings 30 that conform to the array of nipples 12 on the lower disc 6 for the purpose of assembly. (FIG. 3)

Figure 9:
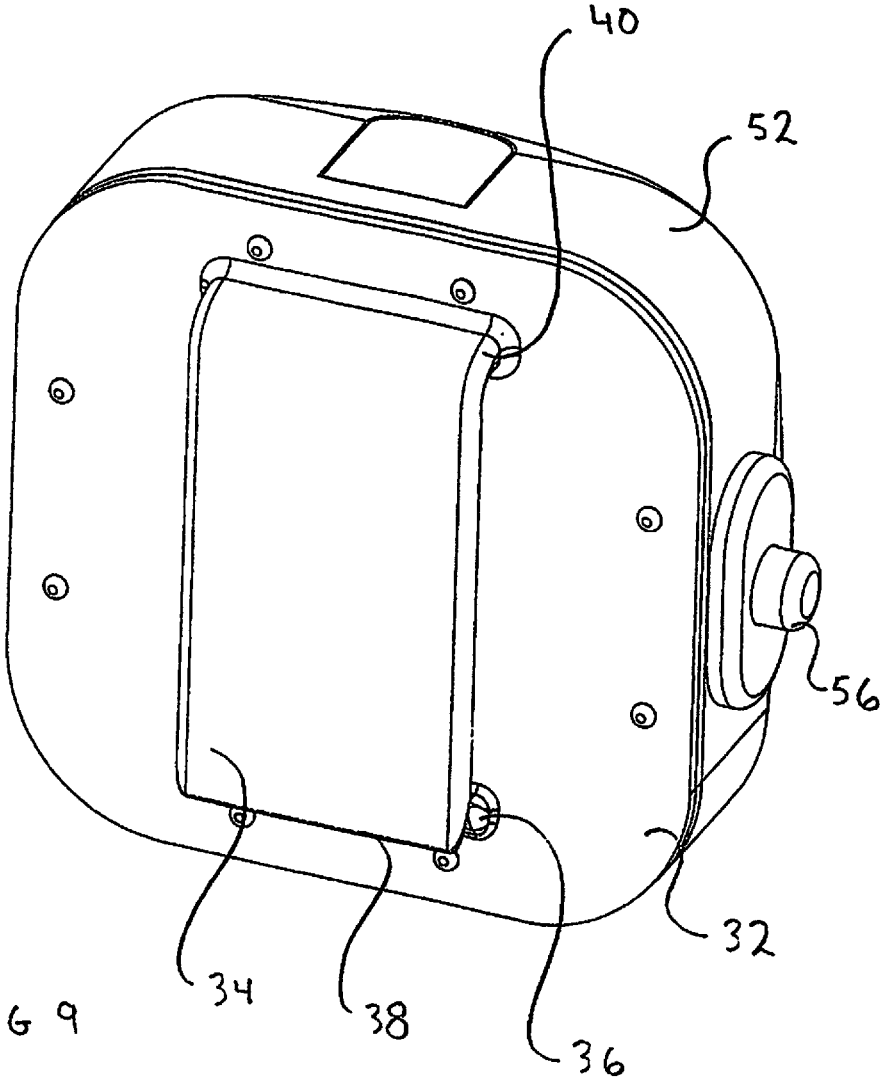
FIG. 9 is a rear perspective view of the emergency light.
Figure 12:
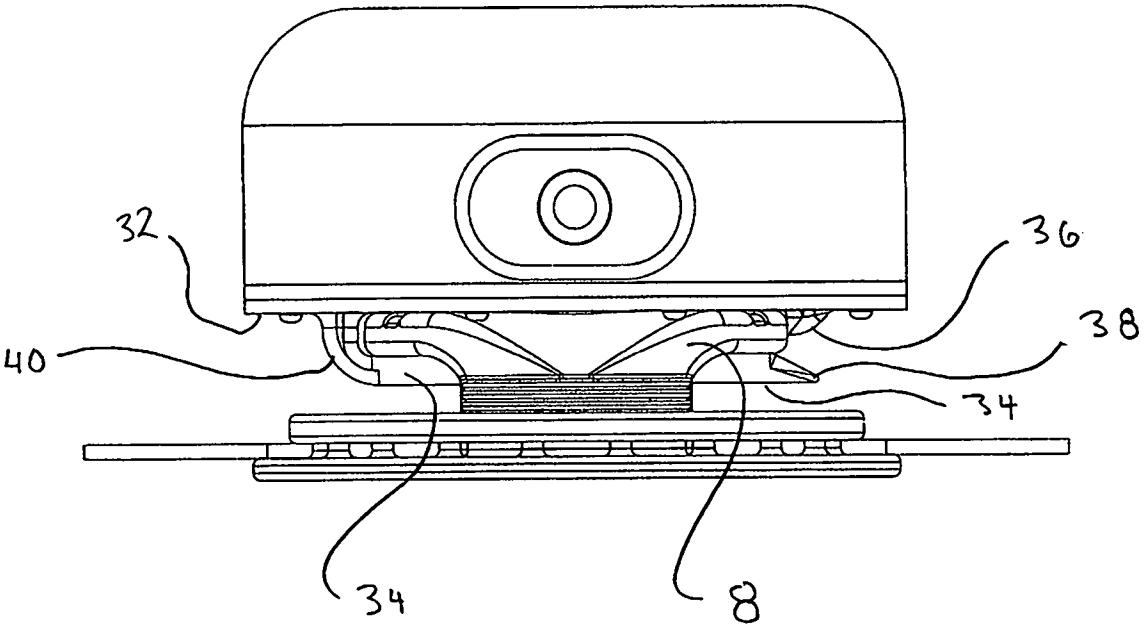
FIG. 12 is a side view of the emergency light coupled to a garment dock.
Figure 13:
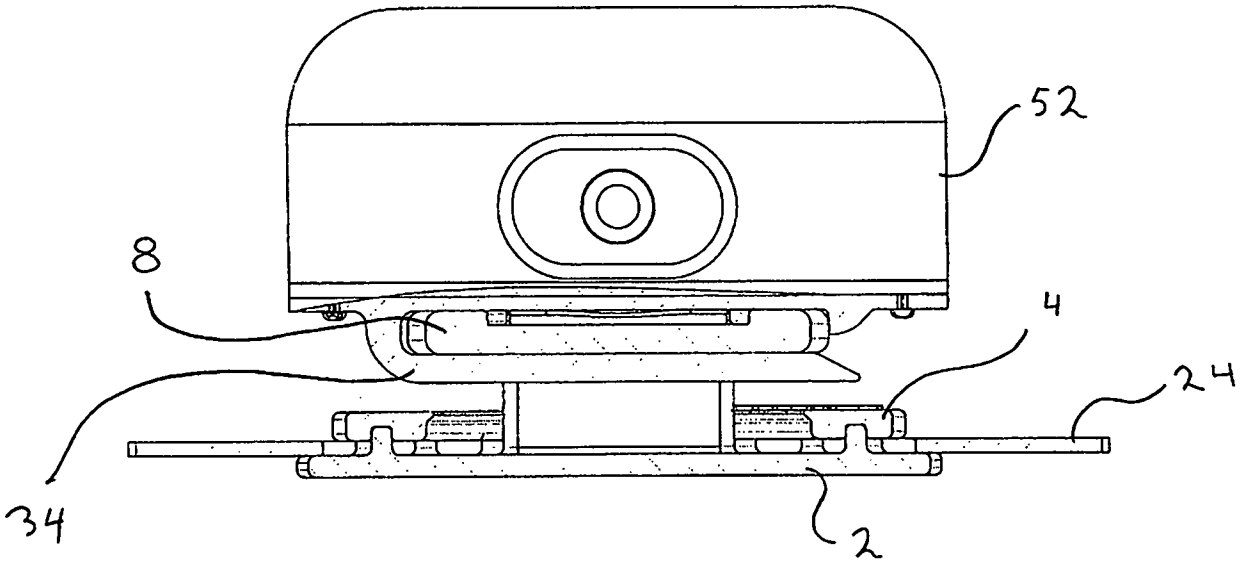
FIG. 13 is a side partial cross sectional view of an emergency light coupled to a garment dock.

The component that attaches a personal device (here, an emergency light 52) to the garment dock 1 is the lock plate 32. This has a planar configuration with a mounting mechanism of a retention tab 34 and lock bar 36 extending therefrom (FIGS. 9, 12 and 13). The lock plate 32 is the base for the mounting mechanism and is mounted to the personal device or incorporated into the physical structure of the personal device. The retention tab 34 is a planar member having a distal end with a tapered edge 38 and a curved proximal end 40 that is attached to, and extends normally from the lock plate 32 so as to allow the retention tab 34 to reside in a spaced, parallel configuration with respect to the plane of the lock plate 32. The retention tab 34 has a width that engages with the slot 11 in the garment dock 1, between the stanchions 10. Adjacent to the tapered edge 38 at the bottom of the retention tab 34 is the lock bar 36. The length of lock bar 36 contacts the tapered edge 38 of the retention tab 34.

The retention tab 34 is made of a material that allows some outward flex of the tab 34 from the lock plate 30. In this way, when the tapered edge 38 at the bottom of the flexible lock bar retention tab 34 and the lock bar 36 is pressed against the upper disk 8 of the garment dock 1, the tab 34 can ramp up over the upper disk 8 and into the slot 11 so as to reside between the stanchions 10. The length of the retention tab between the distal and proximal ends exceeds the diameter of the top disk 8 such that the tapered edge 38 will extend through the slot 11 beyond the upper disk 8, and flex inward again to reside in contact with the lock bar 36. This encircles the upper disk and secures the lock plate 30 to the garment dock 1.

In alternate embodiments, the clothing dock 1 may be affixed directly to the outer face of various elements such as hats, backpacks, with or without a clamp ring 4. In the first alternate embodiment garment dock 45, as can be seen in FIGS. 18-21, there is no stiffening ring 5 utilized but the other components of the clothing dock 1 remain. There is an adhesive pad 46 affixed to the planar, back face of the lower disk 6, This pad 46 will have a dual adhesive face wherein the exposed face will have a protective peelable substrate thereon that will allow the owner to remove this and affix the dock 1 to their desired location.

Figure 23:
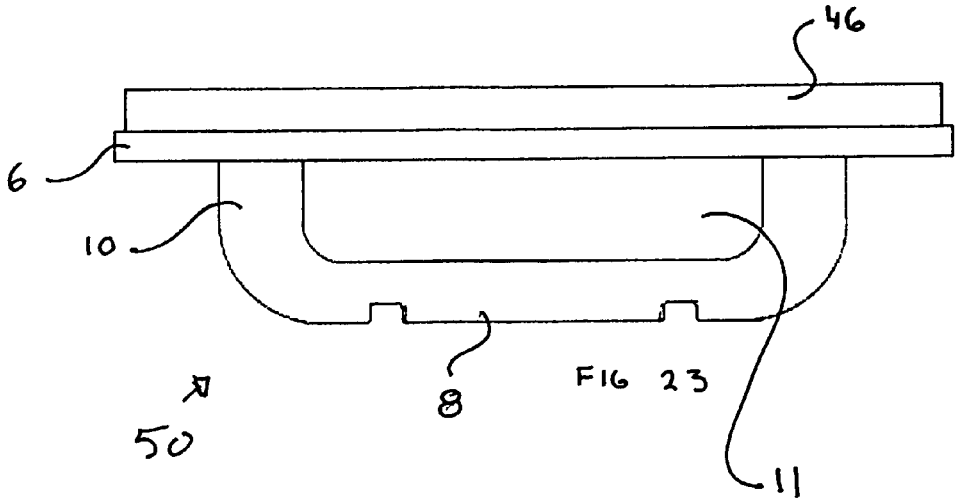
FIG. 23 is a top view of the second alternate embodiment garment dock.
Figure 22:
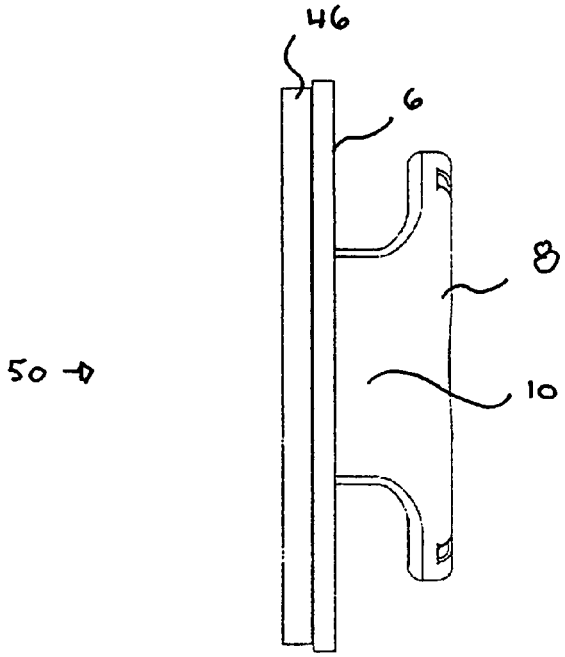
FIG. 22 is a side view of a second alternate embodiment garment dock.

Looking at FIGS. 22 and 23, the second alternate embodiment garment dock 50, it is best illustrated that the nipples 12 on the top face of the lower disk 6 are eliminated and there is no clamp ring 4. The adhesive pad 46 is affixed to the smooth, bottom face of the garment dock post plate 2. It is to be noted that the adhesive component may be as rudimentary as double sided tape or it may be a cushioned double faced adhesive pad 46 discussed above. In other alternate embodiments, the lower disc may be slightly contoured (non-planar) or irregularly shaped for affixation of the garment dock 1 onto specific, contoured articles.

Figure 24:
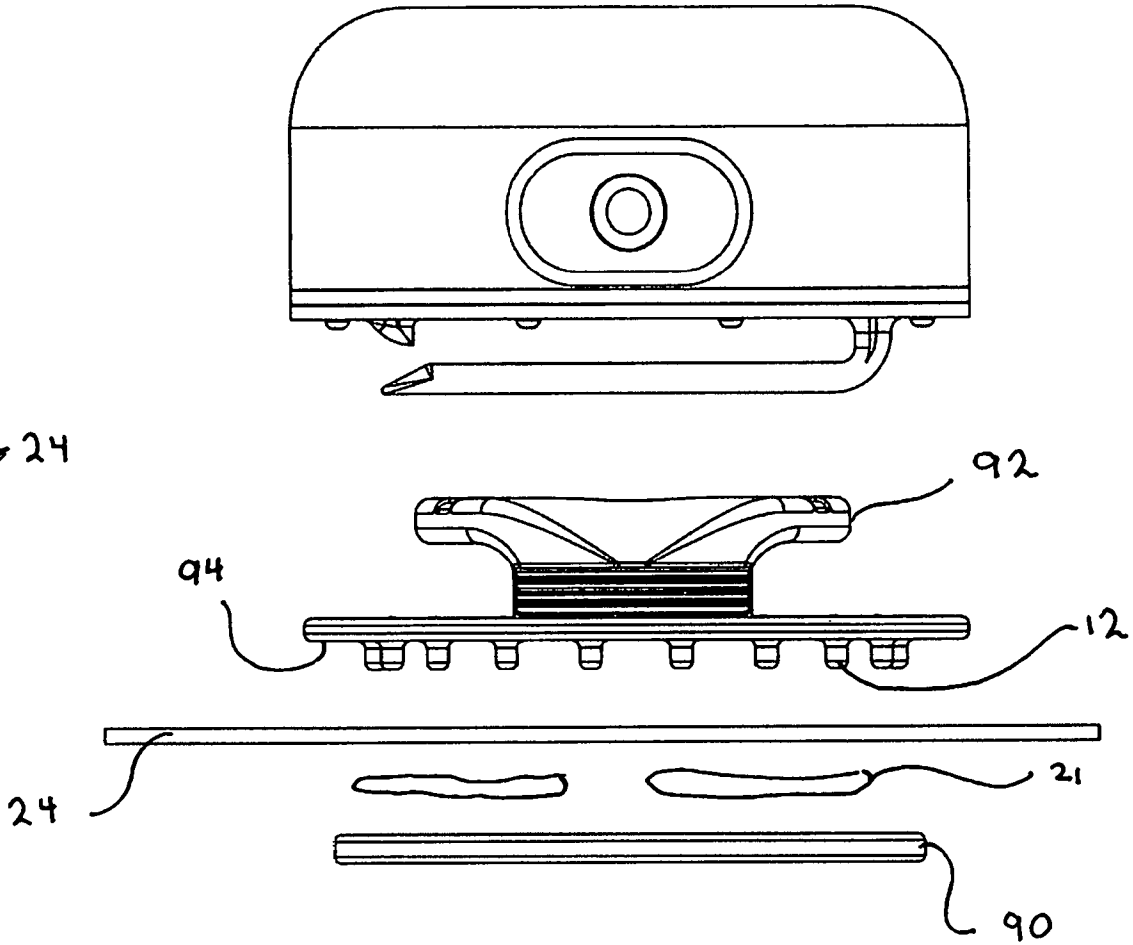
FIG. 24 is a is a side assembly view of a third alternate embodiment garment dock with optional stiffening ring and garment fabric.

In a third alternate embodiment as shown in FIG. 24, affixation of this embodiment onto a garment would not require a cutout of the fabric 24. A stiffening ring as shown in FIG. 6 is optional. In this embodiment the nipples 12 would extend from the lower face 94 of the lower disk of the garment dock post plate 92 and the nipples 12 would be pushed through the fabric 24 from the front side and the modified clamp ring 90 would be positioned on the skin side of the garment such that its recesses engaged the nipples 12 and secured the modified garment dock post plate 92 on the clothing from the inside. (This would be somewhat of a reversal of the preferred embodiment wherein the top face of the lower disk of the garment dock post plate 4 would reside on the inside of the garment and the clamp ring would reside on the outside. Here the bottom face 94 of the lower disk of the garment dock post plate 92 would reside on the outside of the garment and the clamp ring would reside on the inside.) In both the third alternate embodiment and the preferred embodiment the modified clamp ring 90/clamp ring 4 and the modified dock post plate 92/dock post plate 2 may also be joined by an appropriate liquid or hot melt adhesive applied into the nipple recesses and between these joined elements.

Figure 14:
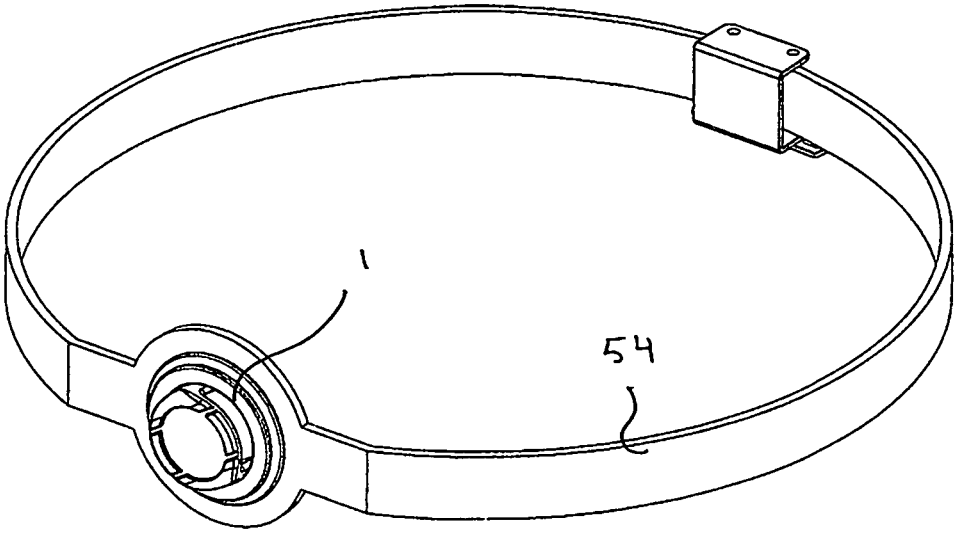
FIG. 14 is a front perspective view of a garment doc affixed to a sizeable strap.
Figure 15:
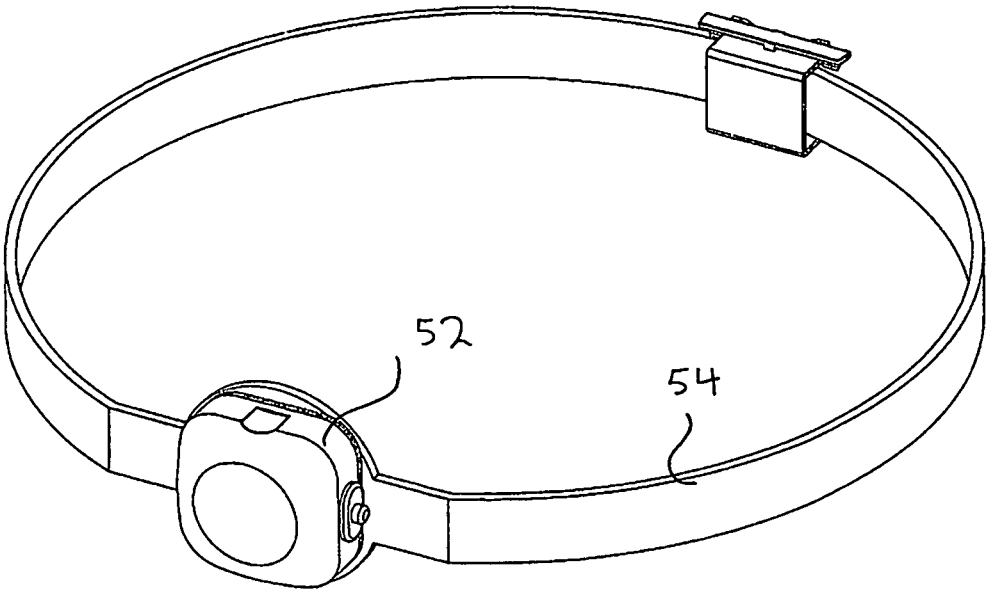
FIG. 15 is a front perspective view of an emergency light coupled to a garment dock affixed to a sizeable strap.
Figure 16:
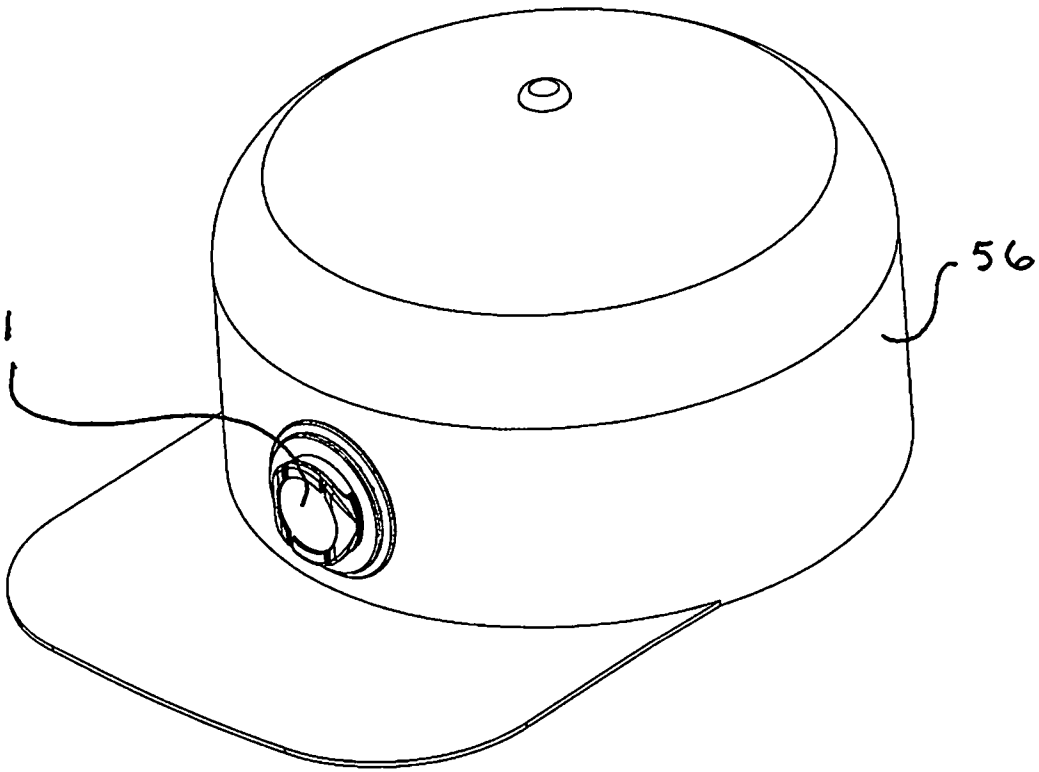
FIG. 16 is a front perspective view of a garment dock affixed to a baseball style cap.
Figure 17:
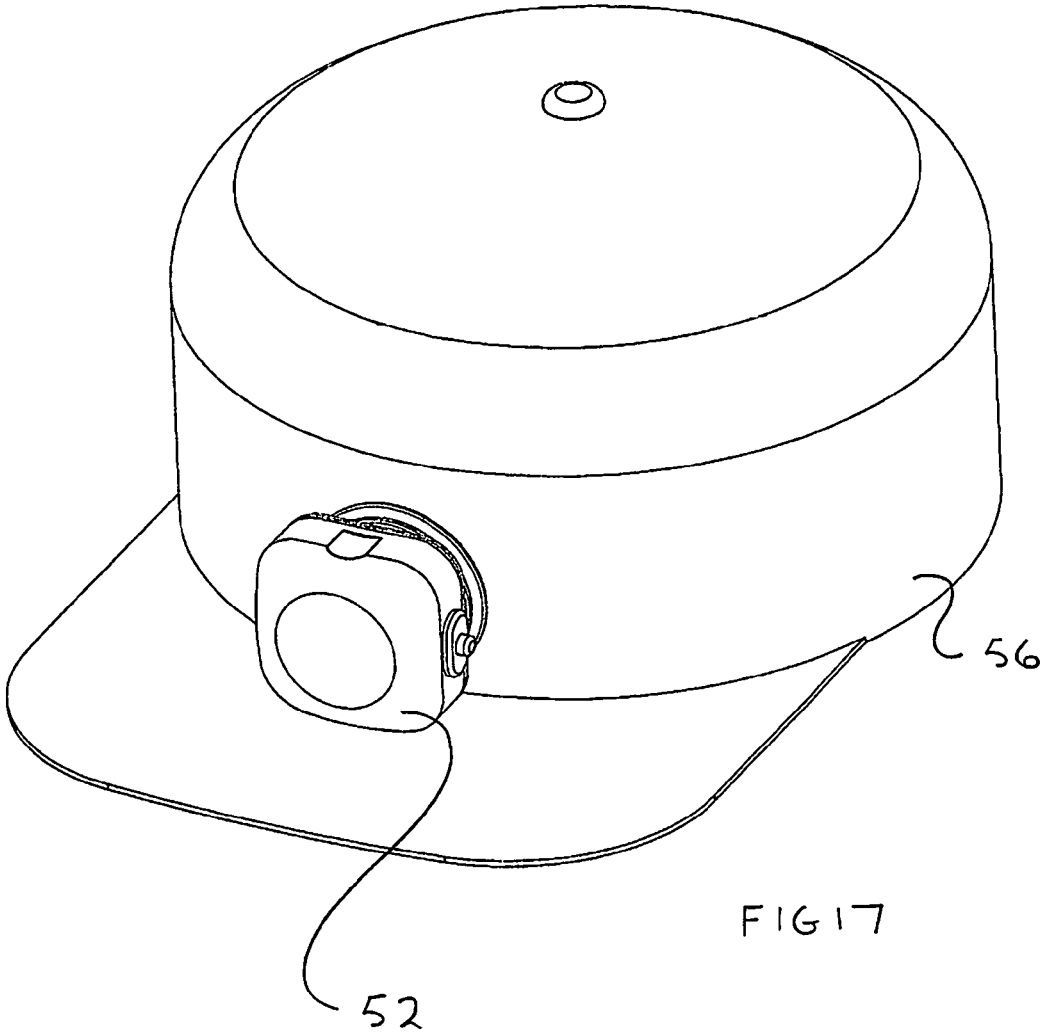
FIG. 17 is a front perspective of an emergency light coupled to a garment dock affixed to a baseball style cap.

The garment dock 1 may be affixed to an adjustable strap 54 that can be worn around the head, arm, leg, trunk or encircled about another object. (FIGS. 14 and 15) In this way the emergency light 52 may be best directed for illumination or display. Similarly, FIGS. 16 and 17 illustrate the garment dock affixed to the fabric of a cloth hat 56 with and without an emergency light attached.

The emergency light 52 (FIGS. 7-9 and 11) is a generally rectangular, lightweight cube having translucent panels on the sides 58 and top face 60 through which any array of illuminated LEDs may be seen. There are numerous LEDs in different colors that illuminate forward or sideward from the rectangular cube. The preferred embodiment weighs less than 46 grams. There are several preset illumination modes available. A selector control switch 56 extends from a side of the rectangular cube. Consecutive actuation of the switch 56 toggles through the different illumination modes. In the preferred embodiment there is a total of 12 LEDs, six facing forward from the front face and six facing sideways from the six perpendicular side faces of the microprocessor board. It uses a 3.7 volt battery with a total capacity of 1.1 amp-hours. The light is both electronically shockproof and waterproof down to 30 meters.

Figure 10:
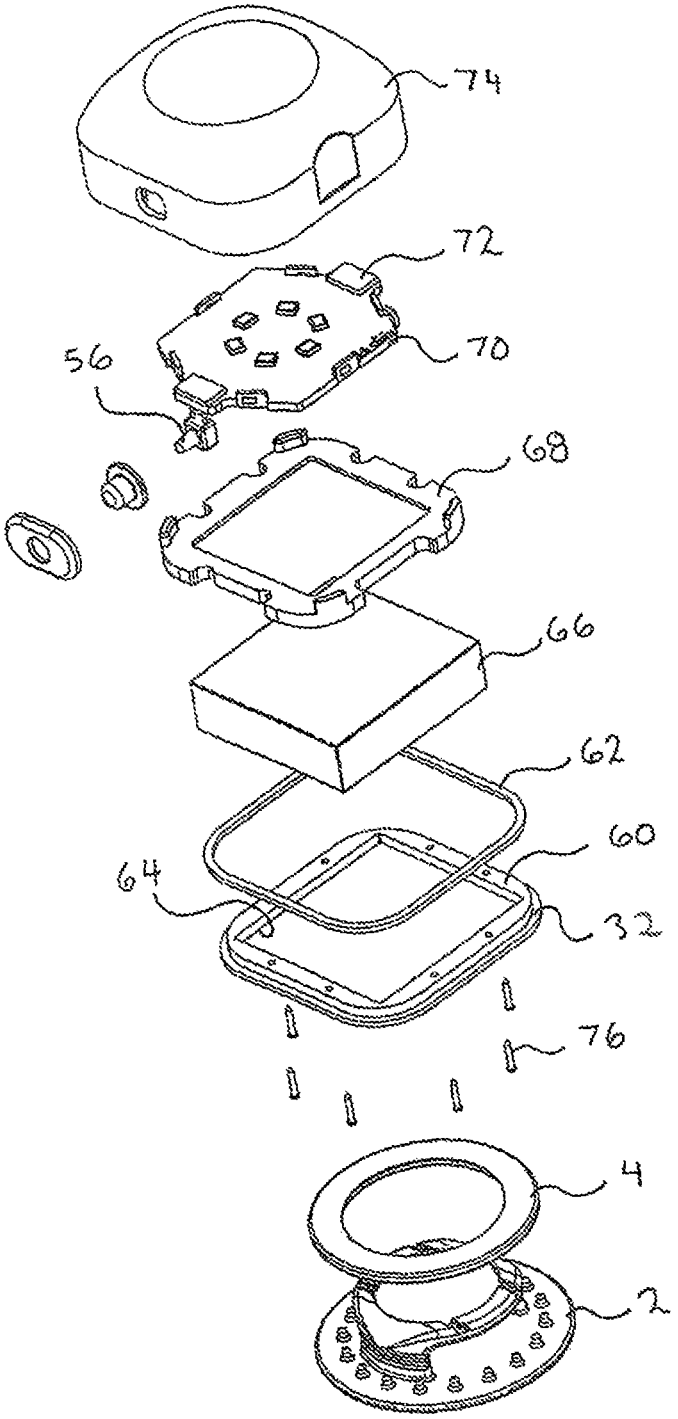
FIG. 10 is a front perspective exploded view of the emergency light.
Figure 11:
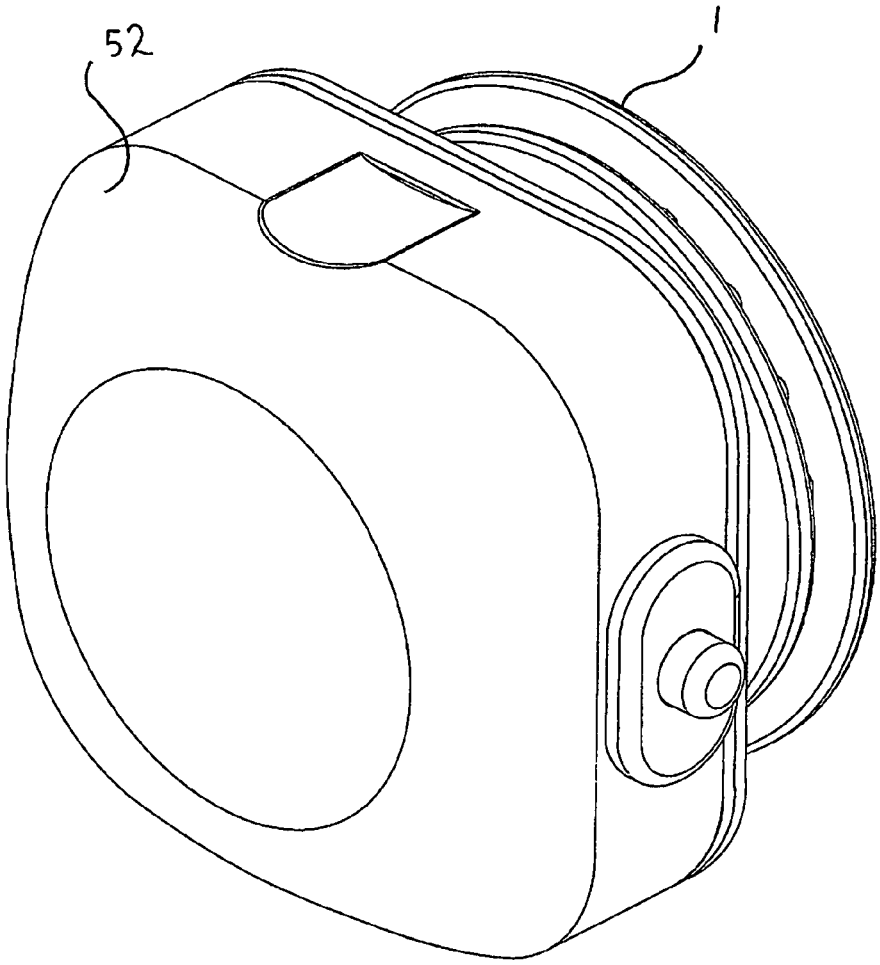
FIG. 11 is a front perspective view of the emergency light coupled to a garment dock.

Looking at FIG. 10 the components of the emergency light 52 can best be seen. The base or support for the light components is the bottom battery housing 60. This is affixed to the back face of the lock plate 30. The lock plate 30 is larger in area and extends beyond the bottom battery housing 60 so as to create a raised lip that the flexible seal 62 that creates the waterproof feature down to 30 meters, can be seated. The bottom battery housing 60 has a recess 64 for the location of the battery 66 thereon. A top battery housing 68 captures the top face of the battery 66 and serves as the mounting bracket for the microprocessor 72 and operationally connected selector control switch 56. On the substrate board 70 the microprocessor 72 resides on are located 12 LEDs. The first six LEDs are mounted on the top planar face (herein referred to as the TPF) of the substrate board in a circular fashion, pointing to the front face of the light 52. The remaining six LEDs are disposed perpendicular to the first six LEDs about the peripheral edges of the substrate 70. The substrate board 70 has eight edges not four, although the general configuration and outer top cover 74 of the light is generally square. The substrate board's edges are not all the same length. There are two long opposing sides that each have one LED thereon, a first and second pair of shorter opposing sides adjacent the long opposing sides that also each have one LED thereon, and a third pair of shorter opposing sides situated between and adjacent the first and second pair of shorter opposing sides that have no LEDS. (Herein referred to as the long sides, the first short sides (FSS), the second short sides (SSS) and the third short sides (TSS)). With this unequal eight sided planar configuration, when the outer top cover 74 installed it appears as if the light has four sides wherein two of the opposing sides have twice as many LEDs at the other two opposing sides. A set of threaded mechanical fasteners 76 pass through orifices in the bottom battery housing 60 and extend into matingly threaded recesses in the top housing to draw all of the components into assembly. The microprocessor contains all of the operational instructions for the light including its LED sequencing, color, timing and LED illumination found in the various modes.

In alternate embodiments, there may be other features incorporated into the light including but not limited to GPS tracking electronics, wireless connectivity capabilities, tri-axial accelerometers (to sense impact) smart device applications to control the parameters of LED brightness, color, battery life and emergency contact notification services.

The light 52 is intended to fulfill multiple purposes determined by the illumination intensity, the number of LEDs illuminated, the location of the LEDs illuminated, the pattern of illuminating LEDs and the speed of the illumination pattern.

In the first mode (torch mode) all six of the TPF LEDs are continually illuminated for a combined power consumption of 1.332 watts and battery duration of 11,000 seconds (3.05 hours).

In the second mode (quarter torch mode) only two of the TPF LEDs are continually illuminated for a combined power consumption of 0.444 watts and a battery duration of 33,000 seconds (9.16 hours).

In the third mode (rotating siren/half beam mode) three of the TPF LEDs flash on for 0.35 seconds and off for 0.01 seconds repeatedly, and two of the FSS or SSS LEDs are alternately illuminated in a fast rate, on for 0.35 seconds and off for 0.01 seconds, for a combined power consumption of 1.020 watts and a battery duration of 14,352 seconds (3.98 hours). The colors also alternate in the FSS and SSS LEDs between white and orange.

In the fourth mode (hyper mode) three of the TPF LEDs flash fast, on for 0.16 seconds and off for 0.12 seconds, and three of either the FSS or SSS LEDs sequence in a rotating fashion, on for 0.16 seconds and off for 0.12 seconds, for a combined power consumption of 1.039 watts and a battery duration of 14,104 seconds (3.91 hours). The colors also alternate in the FSS and SSS LEDs between white and orange.

In the fifth mode (SOS mode) three of the TPF LEDs blink on for 25 seconds and off for 35 seconds, and three of the FSS or SSS LEDs are alternately illuminated with respect to the TPF LEDs illuminating in an alternating slow blinking pattern on for 25 seconds and off for 35 seconds for a combined power consumption of 0.758 watts and a battery duration of 19,343 seconds (5.37 hours).

In an alternate embodiment of the emergency light, an additional button will be added along with a wireless transmitter that when enabled through the simultaneous activation of both buttons, will send a SMS message to all of the user's emergency contacts stored on a server or phone application. There will also be a GPS microprocessor such that the SMS message will include updated GPS coordinates of the location of the emergency light.

Moreover, while the procedures of the methods and processes of installation of the dock onto a garment described herein are described in a particular order for ease of description, unless the context dictates otherwise, various procedures may be reordered, added, and/or omitted in accordance with various embodiments. Likewise, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although exemplary embodiments are described above, it will be appreciated that the invention is intended to cover all modifications and equivalents within the scope of the following claims.

Having thus described the invention, what is claimed as new and desired to be secured by Letters Patent is as follows:

1. A garment docking device, attachable to an article of clothing that allows for the removable attachment of a personal device, said garment docking device comprising:

a garment dock post plate; and a separable clamp ring;

a personal device chosen from the group of small personal devices commonly carried for the purposes of communication, safety, mapping, lighting, tracking, security, emergency or convenience, comprising:

microphones, phones, GPS, lights, pedometers, cameras, knives, signal beacons, stereos and recorders; and a lock plate for affixation to said personal device;

wherein said post plate has a first diameter, generally planar, upper disk held in a spaced parallel configuration from a second diameter, generally planar, lower disk by at least one stanchion so as to form an exposed, accessible slot with a continuous side wall, said slot residing adjacent said stanchion, and said clamp ring is affixed to said lower disk so as to allow the constraint of a fabric there between; and wherein said lock plate is a planar plate with a flexible retention tab extending therefrom, said tab sized for engagement in said slot, thereby retaining said retention tab and any affixed said personal device onto said garment docking device.

2. The garment docking device of claim 1 further comprising an adhesive residing between an upper face of said lower disk and a lower face of said upper disk, and wherein said exposed slot is matingly engageable with a lock plate attached to said personal device by insertion of said lock plate therethrough said slot.

3. The garment docking device of claim 1 further comprising a stiffening ring with a central cutout thereon, said stiffening ring affixed to said fabric and residing adjacent to said top face of said lower disk.

4. The garment docking device of claim 3 further comprising an adhesive residing between an upper face of said stiffening ring and a lower face of said upper disk.

5. The garment docking device of claim 1 wherein the number of stanchions is two.

6. A garment docking device, attachable to an article of clothing that allows for the removable attachment of a personal device, said garment docking device comprising:

a garment dock post plate;

an adhesive member; and a personal device chosen from the group of small personal devices commonly carried for the purposes of communication, safety, mapping, lighting, tracking, security, emergency or convenience, comprising:

microphones, phones, GPS, lights, pedometers, cameras, knifes, signal beacons, stereos and recorders; and a lock plate for affixation to said personal device;

wherein said post plate has a first diameter, generally planar, upper disk held in a spaced parallel configuration from a second diameter, generally planar, lower disk by at least one stanchion so as to form a slot adjacent said stanchion, and said adhesive member is affixed to a bottom face of said lower disk so as to allow an adhesive face of said adhesive member to be bonded to an article; and wherein said lock plate is a planar plate with a flexible retention tab extending therefrom, said tab sized for engagement in said slot, thereby retaining said retention tab and any affixed said personal device onto said garment docking device.

7. The garment docking device of claim 6 wherein the number of stanchions is two.

8. A garment docking device, attachable to an article of clothing that allows for the removable attachment of a personal device, said garment docking device comprising:

a garment dock post plate;

a separable clamp ring;

a personal device chosen from the group of small personal devices commonly carried for the purposes of communication, safety, mapping, lighting, tracking, security, emergency or convenience, comprising:

microphones, phones, GPS, lights, pedometers, cameras, knives, signal beacons, stereos and recorders; and a lock plate for affixation to said personal device;

wherein said garment dock post plate has a first diameter, generally planar, upper disk held in a spaced parallel configuration from a second diameter, generally planar, lower disk by at least one stanchion extending between said upper disk and said lower disk so as to form a slot adjacent said stanchion, and wherein said clamp ring is affixed to said lower disk so as to allow the constraint of a fabric there between; and wherein said lock plate is a planar plate with a flexible retention tab extending therefrom, said tab sized for engagement in said slot, thereby retaining said retention tab and any affixed said personal device onto said garment docking device.

9. The garment docking device of claim 8 wherein the number of stanchions is two, with said slot residing between said stanchions, said stanchions residing in an opposing, mirror image configuration about a plane extending along a centerline of said garment dock post plate.

10. The garment docking device of claim 8 further comprising a lock bar extending from said lock plate and residing adjacent and in contact with a bottom edge of said retention tab, and wherein said retention tab is larger than the diameter of said upper disk such that said bottom edge of said retention tab extends beyond said slot such that when said retention tab is fully inserted into said slot, said retention tab contacts said lock bar so as to encircle said upper disk.

11. The garment docking device of claim 8 wherein said personal device affixed to said lock plate is an emergency light that comprises:

a housing;

a microprocessor controlled array of 12 light emitting diodes;

a microprocessor containing all of the operational instructions for the sequencing, timing and illumination of said light emitting diodes;

a mode selector switch operatively connected to said microprocessor;

a substrate board housed within said housing and having eight edges and an upper planar face, said board housing, said microprocessor, said mode selector switch, six of said light emitting diodes on said planar face, and six of said light emitting diodes each on a separate one of six of said eight edges; and a battery operatively connected to said microprocessor;

wherein said operational instruction contained in microprocessor include a series of different operational mode that alter the illumination sequence, timing intensity and color of said light emitting diodes.

12. The garment docking device of claim 8 wherein said personal device affixed to said lock plate is an emergency light that comprises:

a triaxial accelerometer affixed to said substrate board and in operational contact with said microprocessor for sensing of shock;

a waterproof seal about said housing to enable said light to withstand depths of approximately 30 meters.

13. The garment docking device of claim 1 wherein said lower disk has a lower face with an array of nipples extending therefrom, and wherein said clamp ring has a face with an array of recesses formed therein that are matingly engageable with said array of nipples.

* * * * *